United States Patent [19]

Donofrio

[11] Patent Number: 4,643,778

[45] Date of Patent: Feb. 17, 1987

[54] COMPOSITION AND PROCESS FOR TREATING STEEL

[75] Inventor: John J. Donofrio, Ambler, Pa.

[73] Assignee: Amchem Products, Ambler, Pa.

[21] Appl. No.: 670,694

[22] Filed: Nov. 13, 1984

Related U.S. Application Data

[60] Division of Ser. No. 410,566, Aug. 26, 1982, Pat. No. 4,486,241, which is a continuation-in-part of Ser. No. 303,236, Sep. 17, 1981, abandoned.

[51] Int. Cl.[4] ..... C23C 22/80

[52] U.S. Cl. ..... 148/6.15 R; 106/287.19; 148/6.15 Z

[58] Field of Search ..... 148/6.15 R, 6.15 Z; 106/287.19

[56] References Cited

U.S. PATENT DOCUMENTS 3,141,797 7/1964 Pekar ..... 148/6.15 R
3,864,139 2/1975 Heller ..... 148/6.15 Z

*Primary Examiner*—Sam Silverberg
*Attorney, Agent, or Firm*—Ernest G. Szoke; Henry E. Millson, Jr.; Mark A. Greenfield

[57] ABSTRACT

Aqueous compositions and low temperature processes for treating clean steel and galvanized steel to provide a coating suitable for the application of paint thereto. The aqueous treating compositions contain:

| Ingredient | Quantity |
|---|---|
| zinc ion | from about 0.9 to about 2.5 g/l; |
| nickel ion | from about 0.6 to about 2.0 g/l; |
| orthophosphoric acid | from about 15 to about 45 g/l; |
| nitrate ion | from about 1.0 to about 10.0 g/l. |

The pH of the composition is adjusted to 3.0–3.5 by addition of alkali metal hydroxide. The above composition is used on clean galvanized steel. For clean ungalvanized steel, from about 0.10 to about 0.65 g/l of nitrite ion is included in the composition. Optional ingredients in the above compositions include chlorate ion, ferric ion, and a fluoride compound.

The invention also relates to a metal activating composition comprising an aqueous colloidal solution of manganese ion and a titanium compound.

6 Claims, No Drawings

COMPOSITION AND PROCESS FOR TREATING STEEL

This application is a division of application Ser. No. 410,566, filed 08/26/82, now U.S. Pat. No. 4,486,241 which is itself a continuation-in-part of Ser. No. 303,236, filed 09/17/81 now abandoned.

BACKGROUND

Ungalvanized (ferriferrous) and galvanized (zinciferrous) steel sheets and other components, used, for example, in the automotive and construction industries, are usually painted to both protect the steel against rust and for appearance purposes. It is well known that paint does not perform well on uncoated steel or galvanized steel surfaces, i.e. adhesion characteristics are poor, often resulting in blistering of the paint upon aging, and resistance to corrosion is generally unsatisfactory. Accordingly, both steel and galvanized steel surfaces are pretreated prior to painting, usually by the application of a protective coating such as a zinc phosphate coating.

For many years, zinc phosphate coatings were applied by contacting the steel or galvanized steel surfaces, which were previously cleaned and frequently activated, with a solution containing zinc ions and phosphoric acid at elevated temperatures, e.g. in the range of 125° to 190° F. While the resulting zinc phosphate coatings proved very satisfactory for use under paint, the energy requirements to maintain the treating bath at such temperatures became increasingly expensive as the cost of energy climbed.

Therefore, so-called low temperature baths were developed, i.e. baths having temperatures of 110° F. or less. However, the zinc phosphate coatings resulting from such low temperature baths tended to be coarse and powdery, and in general were much less satisfactory than zinc phosphate coatings produced from higher temperature baths.

DESCRIPTION OF THE INVENTION

There has now been discovered low temperature processes and bath formulations therefor that produce a zinc phosphate coating on clean steel and galvanized steel comparable in all respects to those coatings produced from high temperature processes and baths.

The ungalvanized and galvanized steel that can be treated by the present process includes cold rolled steel and other steel compositions intended to be painted. For example, steel components and parts used in the automotive, construction, and appliance industries are advantageously treated with the compositions and processes of the present invention.

Steel components are prepared for treatment according to the invention by clamping the steel or galvanized steel surfaces by methods and compositions well known to the art, e.g. treatment with alkaline cleaning solutions. Typically, the steel or galvanized steel surface is wiped with a degreasing solvent such as an aliphatic hydrocarbon mixture prior to the cleaning step. When the term "steel" is used hereinafter, it is understood to include both galvanized and ungalvanized steel unless otherwise stated.

Optionally, the cleaned steel can then be activated, using either a composition known to the art or by using a novel composition which comprises part of the present invention.

While the process of the invention resulting in a zinc phosphate conversion coating can be carried out without a prior activation step, heavier and more adhesive conversion coatings generally result when the steel surfaces are activated prior to the application of the conversion coating.

Prior art methods of activating cleaned steel generally involve the use of aqueous colloidal solutions containing a titanium compound. For example, an aqueous colloidal solution of potassium titanium fluoride and disodium phosphate is often employed for this purpose.

The novel activating composition of the invention actually results in greater activation of cleaned steel than that produced with prior art compositions, and heavier phosphate conversion coating weights of a dense, uniform consistency are produced on the surface of the activated steel when a phosphate conversion coating solution is applied thereto. The activating composition of the invention can be used prior to the application of phosphate conversion coatings such as a zinc phosphate or a known manganese-iron phosphate conversion coating. The zinc phosphate coating can be produced either by the novel conversion coating process and composition of the instant invention, or by use of prior art processes and compositions.

The novel activating composition of the invention comprises an aqueous colloidal solution of manganese ion and a titanium compound. The manganese ion is present in at least about 0.005 grams/liter of aqueous solution, preferably from about 0.025 to about 0.075 grams/liter. The manganese ion can be present in the form of an insoluble salt, such as manganese phosphate, manganese carbonate, etc., and this is the preferred form for use herein. However, the manganese ion can also be present in the form of a soluble salt, such as the chloride, sulfate, fluoride, nitrate, etc., but when a soluble salt of manganese is employed the quantity thereof should not exceed about 0.05 grams/liter, since higher quantities tend to interfere with the desired colloidal nature of the solution.

The titanium ion, in the form of a titanium compound in colloidal suspension, is present in from about 0.005 to about 0.02 grams/liter, preferably from about 0.006 to about 0.012 grams/liter. The titanium compound can be any titanium compound that will form a colloidal suspension when added to the aqueous solution in finely divided form. Examples of such titanium compounds include potassium titanium fluoride and potassium titanium oxalate.

Also, alkali metal salts can optionally be included in the aqueous solution, such as alkali metal citrates, phosphates, etc., to stabilize the solution and/or to provide a desired pH, which is normally maintained in the range of 7 to 8, although higher pH's, e.g. up to about 10, are also satisfactory.

The above novel activating solution is applied to the cleaned steel by standard techniques, e.g. by spraying or by immersing the steel in the solution. The solution is maintained at a temperature of from about 60° to about 130° F., preferably from about 70° to about 90° F. Treatment time is at least about 10 seconds, and is preferably from about 30 seconds to about 1 minute.

When the steel is removed from contact with the above activating solution it is then immediately treated, without rinsing, with a conversion coating solution, preferably employing the conversion coating, solutions and processes of the invention described below.

Optionally, the above novel activating solution can be combined with a known alkaline cleaner, whereby the steel is both cleaned and activated in a single step. The combination cleaning/activating solution contains the manganese ion and titanium ion in the same concentrations as are given above for the activation solution formulated without an alkaline cleaner. The alkaline cleaner component of the combination can be an alkaline cleaner used for cleaning steel that contains an alkali metal hydroxide, one or more surfactants, and optionally, an alkali metal silicate and/or other optional ingredients. The combination cleaning/activating solution is applied to the steel at a temperature in the range of about 90° to about 130° F., preferably about 110° to about 120° F. for a treatment time of from about 30 seconds to about 2 minutes, preferably about 60 seconds to 90 seconds. Excess cleaning/activating solution is then removed from the steel, e.g. by rinsing the steel with water, prior to the application of a conversion coating thereto.

Conversion Coating Processes of the Invention:

(1) Clean galvanized or ungalvanized steel, or a combination of such steels, with or without prior activation, is contacted with an aqueous coating solution containing the following ingredients and quantities:

| Ingredients | Grams/Liter of Solution |
|---|---|
| $Zn^{\oplus\oplus}$ | about 0.9 to about 2.5, preferably about 1.5 to about 2.0* |
| $Ni^{\oplus\oplus}$ | about 0.6 to about 2.0, preferably about 1.2 to about 1.7 |
| $H_3PO_4$(100%) | about 15 to about 45, preferably about 20 to about 35 |
| $NO_3^{\ominus}$ | about 1.0 to about 10.0, preferably about 2.0 to about 7.0 |
| $NO_2^{\ominus}$** | about 0.10 to about 0.65, preferably about 0.10 to about 0.40 |

*These ranges are used for the treatment of ungalvanized steel and for the treatment of both galvanized and ungalvanized steel. When treating only galvanized steel, the zinc ion can range from about 0.3 to about 2.5, preferably from about 0.9 to about 2.5, and most preferably from about 1.5 to about 2.0.

**When the steel being treated is galvanized steel only, the nitrite ion may be omitted from the aqueous coating solution, i.e. nitrite ion becomes an optional ingredient therein.

Optionally, one or more of the following ingredients in the quantities given below can also be added to the above aqueous coating solution.

| Optional Ingredients | Grams/Liter of Solution |
|---|---|
| $ClO_3^{\ominus}$* | about 0.4 to about 3.0, preferably about 0.8 to about 1.5 |
| $Fe^{\oplus\oplus\oplus}$ | about 0.010 to about 0.020 |
| Fluoride compound | small quantity |

*Optional but preferred.

When both nitrate and chlorate ions are present in the aqueous coating solution, it is preferred to have the nitrate ion present in a quantity at least twice that of the chlorate ion.

Following the addition of the above ingredients to the aqueous coating solution, the pH of the solution is adjusted into the range of about 3.0 to about 3.5 by the addition of an alkali metal hydroxide, preferably sodium hydroxide or potassium hydroxide. When an alkali metal hydroxide is added, monosodium phosphate is formed by the reaction between the hydroxide and the orthophosphoric acid. The same result could of course be achieved by adding monosodium phosphate separately to the solution and reducing the quantity of orthophosphoric acid added so as to result in a solution having the required pH. However, this technique is quite cumbersome and would be unnecessarily costly.

The divalent zinc ion is supplied to the solution by the addition of any nontoxic inorganic source of this ion, such as zinc oxide, zinc chloride, zinc nitrate, zinc carbonate, zinc bicarbonate, finely divided zinc metal, etc.

The nickel ion is supplied to the solution as any nontoxic inorganic source of this ion, such as nickel oxide, nickel chloride, nickel nitrate, nickel carbonate, nickel bicarbonate, finely divided nickel metal, etc.

The orthophosphonic acid is preferably added in its common commercial form, i.e. as a 75% aqueous solution.

The nitrate and nitrite ions are preferably added to the solution in the form of their alkali metal salts, e.g. the sodium or potassium salts. The nitrate ion can also be added as nitric acid.

When chlorate ion is present, it is preferably added to the solution as an alkali metal chlorate, e.g. sodium chlorate or potassium chlorate.

When ferric ion is added to the solution, ferric chloride is conveniently employed, although ferric salts of the anions given above for the addition of zinc ion can also be employed. It should be noted that even when ferric ion is not deliberately added to the above solution, ferric ion will form in the solution as the steel is being treated.

The fluoride compound that can be present as an optional ingredient can be in the form of a fluoride salt or a complex fluoride, e.g. fluosilicic acid, fluotitanic acid, ammonium bifluoride, sodium bifluoride, etc.

The steel being treated is contacted by the above solution by spraying the solution onto the steel, or immersing the steel in the solution.

The above solution is maintained at a temperature of from about 80° to about 125° F., preferably from about 85° to about 95° F. Contact time with the steel is at least 30 seconds, preferably from about 30 seconds to about 5 minutes, and most preferably from about 30 seconds to about 2 minutes. Contact times longer than 5 minutes can be used without increasing the heaviness of the coating, since an equilibrium is obtained rather quickly between the coating and the solution, but such long contact times serve no practical purpose.

(2) Excess solution is then removed from the coated steel, preferably by rinsing with water to remove the excess coating solution from the surface of the coated steel. This rinsing step can be carried out at ambient temperatures, by either spraying or immersing the steel in the rinse water.

An optional step that may be employed in the process of the invention is a final treatment step following step (2), which is carried out by contacting the coated steel with an acidified aqueous solution containing trivalent chromium ion, hexavalent chromium ion, or a hexavalent/trivalent chromium ion mixture. Such solutions and methods for treating the coated steel are known to the art and are often used to treat zinc phosphate coated steel obtained by known processes.

The aqueous compositions of the present invention set forth in step (1) above differ from prior art cold treatment compositions by having a much higher concentration of nickel ion and a much lower zinc ion concentration. Also, many prior art compositions require the presence of manganese, which is not required or desired in the present compositions described in step (1) above.

When clean steel was contacted with the above solution by spraying the solution onto the steel for one minute, a coating was formed which contained about two to three times the amount of divalent nickel ions present in conventional zinc phosphate coatings. This result was determined by stripping the zinc phosphate coating with a solution of chromic acid (5% wt/vol) and analyzing this solution by Atomic Absorption Spectroscopy. Such zinc phosphate coatings were also analyzed by Auger Electron Spectroscopy using a high resolution (~500 Å) Perkin-Elmer Physical Electronics Division (PHI) Model 595 Multiprobe which combines scanning electron microscopy and scanning Auger spectroscopy. It was found that the divalent nickel ion was concentrated in the outer 100 Å of the coated surface. When clean steel was contacted by the above solution by immersing the steel in the solution for 2 minutes, a coating was formed which contained a greater ratio of phosphophyllite ($Zn_2FeP_2O_8.4H_2O$) to hopeite ($Zn_3P_2O_8.4H_2O$) than in conventional zinc phosphate coatings. This was determined by stripping the zinc phosphate coating with a solution of chromic acid (5% wt/vol) and analyzing this solution by Atomic Absorption Spectroscopy. Such zinc phosphate coatings were also analyzed by Auger Electron Spectroscopy to coating depths of 3000 Å and this analysis showed the presence of about 11% Fe (Relative Atomic %). The zinc-iron phosphate coatings produced by the novel coating composition of the invention result in a greater degree of corrosion protection and paint adhesion than with conventional zinc phosphate coatings containing only hopeite.

The aqueous compositions of the invention also result in very little sludge formation in use and on standing, unlike prior art compositions which tend to sludge heavily. Furthermore, concentrates useful in forming the present aqueous treatment compositions can be formed and are quite stable on storage. The concentrates which can be employed, and which comprise part of the present invention, contain the above ingredients (except nitrite) in concentrated aqueous solution, i.e. wherein the ingredients are present in amounts greater than in the aqueous compositions, e.g. the zinc ion is present in more than about 2.5 g/l. Each ingredient is present in the concentrate in quantity sufficient to provide the required amounts in the aqueous treating solutions that result when the concentrate is diluted with a controlled quantity of water. The concentrates preferably contain at least about 30 g/l of zinc ion. The parts-by-weight relationship of the ingredients of the concentrate, assigning zinc as 1 for convenience, is as follows:

| | Parts by weight |
|---|---|
| Ingredient* | |
| $Zn^{\oplus\oplus}$ | 1 |
| $Ni^{\oplus\oplus}$ | about 0.24 to about 2.2, preferably about 0.6 to about 1.1 |
| $H_3PO_4$(100%) | about 6 to about 50, preferably about 10 to about 23.3 |
| $NO_3^{\ominus}$ | about 0.4 to about 11.1, preferably about 1 to about 2.8 |
| Optional Ingredients | |
| $ClO_3^{\ominus}$ | about 0.16 to about 3.3, preferably about 0.4 to about 0.6 |
| $Fe^{\oplus\oplus\oplus}$ | about 0.004 to about 0.022, preferably about 0.005 to about 0.013 |

NOTE: When the concentrate is prepared for use in making up coating baths to be used for galvanized steel only, the parts-by-weight relationships of the ingredients are as follows:

-continued

| | Parts by weight |
|---|---|
| Ingredient | |
| $Zn^{\oplus\oplus}$ | 1 |
| $Ni^{\oplus\oplus}$ | about 0.24 to about 6.7, preferably about 0.24 to about 2.2, and more preferably about 0.6 to about 1.1 |
| $H_3PO_4$(100%) | about 6 to about 150, preferably about 6 to about 50, and more preferably about 10 to about 23.3 |
| $NO_3^{\ominus}$ | about 0.4 to about 33.3, preferably about 0.4 to about 11.1, and more preferably about 1 to about 2.8 |
| Optional Ingredients | |
| $ClO_3^{\ominus}$ | about 0.16 to about 10, preferably about 0.16 to about 3.3, and more preferably about 0.4 to about 0.6 |
| $Fe^{\oplus\oplus\oplus}$ | about 0.004 to about 0.067, preferably about 0.004 to about 0.022, and more preferably about 0.005 to about 0.013 |

*Nitrite is added separately to the bath since it tends to be unstable in the concentrate.

The processes and compositions of the invention can be better understood from the following examples, which are given for illustration purposes only, and are not meant to limit the invention.

EXAMPLE I

Three cold rolled steel panels (AISI 1010 low carbon steel alloy), which had been cleaned using a titanium activated, silicated, strongly alkaline solution (RIDOLINE 1310, Amchem Products, Inc.), were treated as follows:

An aqueous coating bath was formed containing the following quantities of ingredients:

| Coating Bath | |
|---|---|
| Ingredients | Grams/Liter of Solution |
| ZnO | 2.25 |
| NiO | 1.86 |
| $H_3PO_4$(100%) | 26.54 |
| $NaClO_3$ | 1.29 |
| $NaNO_3$ | 3.96 |
| $NaNO_2$ | 0.24 |
| $FeCl_3.6H_2O$ | 0.076 |
| NaOH | 4.40 |

The above aqueous bath was then adjusted to pH 3.3 by the addition of NaOH. The above aqueous bath was formed by adding the following concentrate to water in amount sufficient to form a 5% solution of the concentrate in the water, followed by separate addition of the $NaNO_2$ and adjustment of the pH to 3.3:

| Concentrate | |
|---|---|
| Ingredients | Grams/Liter of Concentrate |
| ZnO | 44.96 |
| NiO | 37.12 |
| $H_3PO_4$(75%) | 707.68 |
| NaOH(50% solution) | 176.20 |
| $NaClO_3$ | 25.84 |
| $NaNO_3$ | 79.20 |
| $FeCl_3.6H_2O$ | 1.52 |

The above concentrate was formed by first slurrying the zinc oxide and nickel oxide in hot water and mixing thoroughly. The phosphoric acid was then slowly added to the stirred mixture until the solution became clear. The solution was then allowed to cool to about 100° F., and the sodium hydroxide solution added slowly with stirring. After the resulting solution had cooled to about 120° F., the sodium nitrate, sodium chlorate and ferric chloride hexahydrate were added and the solution stirred until clear.

The coating bath was then heated to 95° F. and the steel panels were sprayed with the bath for one minute, resulting in a zinc phosphate coating on the steel substrate.

The steel panels were then rinsed with tap water to remove excess coating solution.

The phosphate coated steel panels were next treated with an aqueous solution containing 0.025% by volume of chromium acetate and 0.0008% by volume of hydrazine hydrate, and adjusted to a pH of 4.0 to 5.0 by the addition of $H_3PO_4$ (75% solution). The above solution was applied to the steel panels by spraying the surfaces of the panels for about 30 seconds.

The excess solution was removed from the steel panels by rinsing the panels in distilled water. The panels were then air dried, and immersed in a PPG 3002 cathodic electrodeposition primer bath. The panels were removed from the primer bath, rinsed with distilled water to remove excess primer, and oven baked at 360° F. for 20 minutes. Then a DuPont #922 acrylic enamel topcoat was applied using standard electrostatic spray equipment. The panels were then baked in an oven at 250° F. for 30 minutes. The total thickness of primer plus topcoat was 2.1 to 2.5 mil. The topcoat after baking was smooth, uniform and highly adhesive. The panels were then tested in the following tests:

Panel 1—Salt Spray Test ASTM B-117.

Panel 2—10 Cycle Scab Test. In this test the panel is scribed according to ASTM D-1654 with a 4" horizontal scribe beginning four inches down from the top of the panel. The scribed panel is then subjected to 10 cycles, each cycle consisting of (a) a 24 hour salt spray (ASTM B-117), (b) four 24 hour humidity treatments, each treatment consisting of 8 hours at 100% relative humidity at 100° F.±2° F. and 16 hours at normal room temperature and relative humidity, and (c) 48 hours at normal room temperature and relative humidity. The panel is then rinsed with water, dried and examined.

Panel 3—Wet Adhesion Test. This test is carried out by immersing the panel for 240 hours in deionized water at 50° C. The panel is then removed, air dried, and cross scribe test ASTM D-3359 carried out, except that 10 cross hatch lines of 2 mm width were used in the test. The results of the above tests are as follows:

Panel 1—Salt Spray Test ASTM B-117. Average loss from scribe after 1500 hours exposure—3/64".

Panel 2—10 Cycle Scab Blister Test. Average loss from scribe—1.4 mm.

Panel 3—Wet Adhesion Test. After 240 hours, no paint loss.

EXAMPLE II

Three cold rolled steel panels of the same composition as those used in Example I were treated in accordance with the process of Example I, except that the following process was employed after the phosphate coated steel panels were rinsed with tap water to remove excess coating solution:

The phosphate coated steel panels were then rinsed with distilled water at room temperature and air dried. The same paint system as in Example I was applied to the panels and the following tests carried out as in Example I:

Panel 1—Salt Spray Test ASTM B-117.

Panel 2—10 Cycle Scab Blister Test.

Panel 3—Wet Adhesion Test.

The results obtained are as follows:

Panel 1—Salt Spray Test ASTM B-117. Average loss from scribe after 1500 hours exposure—1/32".

Panel 2—10 Cycle Scab Blister Test. Average loss from scribe—6 mm.

Panel 3—Wet Adhesion Test. 95% of the paint adhered within the cross hatched area.

EXAMPLE III

Three cold rolled steel panels (AISI 1010 low carbon steel alloy), were cleaned as set forth in Example I. The panels were rinsed with tap water to remove excess cleaner and the panels were then dipped for 30 seconds into a metal activating solution at 80° F. containing 1.2 grams, per liter of water, of a mixture having the following composition:

| Ingredients | % by weight |
|---|---|
| potassium titanium fluoride | 3.5 |
| disodium phosphate | 77.5 |
| tetrasodium pyrophosphate | 19 |

An aqueous coating bath was formed as set forth in Example I, heated to 95° F., and the steel panels were immersed in the bath for 2 minutes, resulting in a smooth zinc phosphate coating on the surfaces of the steel. The steel panels were rinsed with tap water to remove excess coating solution, followed by a distilled water rinse. The panels were then air dried and a paint system applied as in Example I. The following tests were carried out with the following results:

Panel 1—Salt Spray Test ASTM B-117. Average loss from scribe after 1500 hours exposure—1/64".

Panel 2—Cycle Scab Blister Test. Average loss from scribe—1 mm.

Panel 3—Wet Adhesion Test. No paint loss.

EXAMPLE IV

The process of Example III was repeated with another three cold rolled steel panels of the same composition, except that the panels were treated as follows after the tap water rinse to remove excess coating solution:

The panels were then dipped into an aqueous solution containing 200 ppm hexavalent chromium and 85 ppm of trivalent chromium at ambient temperature for 20 seconds. The panels were then removed from the solution and rinsed with distilled water to remove excess solution, followed by air drying. The same paint system used in Example I was then applied to the panels in the manner set forth in Example I.

The resulting painted panels were smooth, the paint was distributed uniformly, and was highly adhesive.

The panels were then subjected to the following tests, with the results given below:

Panel 1—Salt Spray Test ASTM B-117. Average loss from scribe after 1500 hours exposure—1/64".

Panel 2—10 Cycle Scab Blister Test. Average loss from scribe—1 mm.

Panel 3—Wet Adhesion Test. No paint loss.

EXAMPLE V

Three galvanized steel panels (Armco G90—hot dipped, galvanized, minimum spangle) were cleaned using a titanium activated, silicated strongly alkaline solution (RIDOLINE 1310, Amchem Products, Inc.).

The panels were then rinsed in tap water and sprayed for 30 seconds with a metal activating solution at 80° F. containing 1.2 grams, per liter of water, of a mixture having the following composition:

| Ingredients | % by weight |
|---|---|
| potassium titanium fluoride | 5 |
| disodium phosphate | 95 |

The galvanized steel panels were then sprayed for 1 minute at 95° F. with a coating bath having the following composition:

| Ingredients | Coating Bath Grams/Liter of Solution |
|---|---|
| ZnO | 2.25 |
| NiO | 1.86 |
| $H_3PO_4$(100%) | 26.54 |
| $NaClO_3$ | 1.29 |
| $NaNO_3$ | 3.96 |
| $FeCl_3.6H_2O$ | 0.076 |
| NaOH | 4.40 |

The above bath was adjusted to pH 3.3 by the addition of NaOH prior to use.

The galvanized steel panels were then rinsed with tap water, followed by spraying for 30 seconds at room temperature with an aqueous solution containing 0.025% by volume of chromium acetate and 0.0008% by volume of hydrazine hydrate, and adjusted to a pH of 4.0 to 5.0 by the addition of $H_3PO_4$ (75% solution).

The excess solution was removed from the galvanized steel panels by rinsing the panels in distilled water. The panels were then air dried, and the paint system of Example I applied in accordance with the process of Example I.

The paint after drying was smooth, uniform and highly adhesive. The panels were tested as follows with the results given below:

Panel 1—Salt Spray Test ASTM B-117. Average loss from scribe after 672 hours exposure—5/64".

Panel 2—10 Cycle Scab Blister Test. Average loss from scribe—0.5 mm.

Panel 3—Wet Adhesion Test. 97% of the paint adhered to the cross hatched area.

EXAMPLE IV

Three galvanized steel panels (Armco G90—hot dipped, galvanized, minimum spangle) were cleaned, treated and painted as in Example V except that the metal activating solution contained 1.2 grams, per liter of water, of a mixture having the following compositions:

| Ingredients | % by weight |
|---|---|
| manganese nitrate | 0.01 |
| potassium titanium fluoride | 5.00 |
| disodium phosphate | 94.99 |

The panels were tested and results obtained as follows:

Panel 1—Salt Spray Test ASTM B-117. Average loss from scribe after 672 hours exposure—1/16".

Panel 2—10 Cycles Scab Blister Test. Average loss from scribe—0.5 mm.

Panel 3—Wet Adhesion Test. 99% of the paint adhered to the cross hatched area.

EXAMPLE VII

A cold rolled steel panel (AISI 1010 low carbon steel alloy) was cleaned using a titanium activated, silicated, strongly alkaline solution (RIDOLINE 1310, Amchem Products, Inc.).

The panel was then rinsed in tap water and sprayed for 30 seconds with a metal activating solution at 80° F. containing 1.2 grams, per liter of water, of a mixture having the following composition:

| Ingredients | % by weight |
|---|---|
| potassium titanium fluoride | 5 |
| disodium phosphate | 95 |

The steel panel was then sprayed with the coating bath of Example I at 95° F. for 1 minute.

The steel panel was then rinsed with tap water, and an aqueous solution containing 200 ppm hexavalent chromium and 85 ppm of trivalent chromium at ambient temperature was sprayed onto the surfaces of the panel for 20 seconds. The panel was then rinsed with distilled water, followed by air drying.

A single coat alkyd paint (Guardsman light tan single coat, Guardsman Paint Company) which is used frequently in the fabricated metal industry, was sprayed onto the surfaces of the panel, and the panel was then baked in an oven for 12 minutes at 325° F. The paint film was from 1.0 to 1.2 mils thick. The panel was then tested with the Salt Spray Test ASTM B-117 for 168 hours.

Average loss from scribe—1/32".

What is claimed is:

1. A process for activating clean steel or galvanized steel prior to the application of a phosphate conversion coating thereto comprising contacting the clean steel or galvanized steel with an aqueous colloidal solution comprising at least about 0.005 grams/liter of manganese ion and from about 0.005 to about 0.02 grams/liter of titanium ion.

2. A process in accordance with claim 1 wherein the manganese ion is present in from about 0.025 to about 0.075 grams/liter and the titanium ion is present in from about 0.006 to about 0.012 grams/liter.

3. An aqueous composition for the activation of galvanized or ungalvanized steel prior to the application of a phosphate conversion coating thereto comprising:

(a) at least about 0.005 grams/liter of manganese ion; and (b) from about 0.005 to about 0.02 grams/liter of titanium ion.

4. An aqueous composition in accordance with claim 3 wherein from about 0.025 to about 0.075 grams/liter of manganese ion are present and from about 0.006 to about 0.012 grams/liter of titanium ion are present.

5. An aqueous composition in accordance with claim 3 wherein the solution also contains an alkali metal citrate or phosphate in amount sufficient to provide a pH in the range of from about 7.0 to about 10.0.

6. An aqueous composition in accordance with claim 3 which also contains an alkaline cleaning composition suitable for cleaning the steel.

* * * * *